US005890042A

United States Patent [19]

Wong et al.

[11] Patent Number: 5,890,042

[45] Date of Patent: Mar. 30, 1999

[54] HYBRID JUMPING DEVELOPER WITH PULSE WIDTH COMPENSATED TONER MASS CONTROL

[75] Inventors: Lam F. Wong, Fairport; Michael G. Swales, Sodus, both of N.Y.

[73] Assignee: Xerox Corporation, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 624,275

[22] Filed: Mar. 29, 1996

[51] Int. Cl.[6] ..... G03G 15/08

[52] U.S. Cl. ..... 399/285; 399/291

[58] Field of Search ..... 399/265, 266, 399/279, 285, 290, 291

[56] References Cited

U.S. PATENT DOCUMENTS

| | | | |
|---|---|---|---|
| 3,873,002 | 3/1975 | Davidson et al. | 222/56 |
| 4,086,872 | 5/1978 | Pan | 399/292 X |
| 4,318,610 | 3/1982 | Grace | 355/14 D |
| 4,326,646 | 4/1982 | Lavery et al. | 222/56 |
| 4,348,099 | 9/1982 | Fantozzi | 355/14 E |
| 4,868,600 | 9/1989 | Hays et al. | 355/259 |
| 4,956,669 | 9/1990 | Nakamura et al. | 355/208 |
| 5,081,491 | 1/1992 | Lux et al. | 355/208 |
| 5,339,142 | 8/1994 | Hays | 399/266 X |
| 5,359,399 | 10/1994 | Bores et al. | 399/266 |
| 5,404,208 | 4/1995 | Edmunds | 399/266 |
| 5,499,084 | 3/1996 | Folkins et al. | 399/285 X |

*Primary Examiner*—Fred L. Braun
*Attorney, Agent, or Firm*—Kevin R. Kepner

[57] ABSTRACT

A hybrid jumping development system utilizing two component developer and providing an improved device for controlling developed toner mass. Toner is metered onto a donor structure and a toner cloud is formed in a development nip between the donor structure and the charge retentive surface having a latent electrostatic image thereon. The toner cloud is formed by applying an alternating potential to the donor structure so as to cause the toner particles to jump off of the donor structure. The duty cycle of the AC potential is used to control the toner cloud and thus the amount of toner developed on the charge retentive surface.

18 Claims, 2 Drawing Sheets

HYBRID JUMPING DEVELOPER WITH PULSE WIDTH COMPENSATED TONER MASS CONTROL

This invention relates generally to a hybrid jumping developer system, and more particularly concerns a hybrid jumping system having pulse width compensated toner mass control.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

In a machine of the foregoing type, utilizing a hybrid jumping development (HJD) system, the development roll, better known as the donor roll, is powered by two development fields (potentials across an air gap). The first field is the ac jumping field which is used for toner cloud generation and has a typical potential of 2.6 k volts peak to peak at 3.25 k Hz frequency. The second field is the dc development field which is used to control the amount of developed toner mass on the photoreceptor. It is desirable to eliminate the dc field and use the duty cycle of the ac field to control the toner mass to be developed on the photoreceptor.

Various approaches have been devised for controlling the concentration of toner in the development system. The following disclosures appear to be relevant:

U.S. Pat. No. 3,873,002
Patentee: Davidson et al.
Issued: Mar. 25, 1975.
U.S. Pat. No. 4,318,610
Patentee: Grace.
Issued: Mar. 9, 1982.
U.S. Pat. No. 4,326,646
Patentee: Lavery et al.
Issued: Apr. 27, 1982.
U.S. Pat. No. 4,348,099
Patentee: Fantozzi.
Issued: Sep. 7, 1982.
U.S. Pat. No. 4,868,600
Patentee: Hays et al.
Issued: Sep. 19, 1989.
U.S. Pat. No. 4,956,669
Patentee: Nakamura et al.
Issued: Sep. 11, 1990.
U.S. Pat. No. 5,081,491
Patentee: Lux et al.
Issued: Jan. 14, 1992
U.S. application Ser. No. 08/529,796
Inventor: Wong
Filed: Sep. 18, 1995

Some relevant portions of the foregoing patents and application may be summarized as follows:

Davidson et al. describes a control device which regulates the dispensing of predetermined quantities of particles from a storage container to a mix for maintaining the concentration thereof substantially at a preselected level. Specifically, a detecting means is used to determine the toner concentration and to signal a count detector. Subsequently, control logic analyzes the value contained in the count defector to determine whether a half or full toner dispense cycle is required.

Grace describes an apparatus in which toner particle concentration within a developer mixture and charging of the photoconductive surface are controlled. More specifically, an infrared densitometer generates electrical signals proportional to the developed toner mass of test areas on the photoconductive surface. The signals are fed through a conversion circuit and subsequently interpreted by a controller. The controller energizes a toner dispense motor, via a logic interface, whenever the detected density of the toner concentration test patch is below a nominal level. In addition, successive energizing of the toner dispense motor without an increase in detected density results in the generation of a "toner container empty" signal by the controller.

Lavery et al. discloses an automatic development control system utilizing a control loop to vary the time period of activation of a toner dispenser. The toner dispenser is activated for a predetermined fraction of the copy cycle depending upon the relative density of a test patch versus a desired density. For example, when the detected test patch toner density is first indicated as low, the toner dispenser is activated for a period of 0.5 seconds. For successive indications of a low toner density the toner dispenser is activated in increments of 0.5 seconds up to a maximum period of 1.5 seconds.

Fantozzi teaches a sample data control system for controlling charge, illumination, toner dispensing, and developer bias. The system disclosed utilizes a toner dispensing control loop for regulating toner, wherein the control loop responds to a signal from an infrared sensor which detects the density of a developed test patch. Specifically, the voltage level from the sensor is compared against a reference voltage. If the voltage from the sensor is indicative of a toner density less than the desired density, the dispense motor is activated at a low or high rate. Once the toner density is determined to be sufficiently greater than the desired density, the dispense motor is turned off. This control process continues with the dispense motor being activated as required and the adjustment or activation of the toner dispenser being made if required preferably after each even copy cycle.

Hays et al. discloses a scavengeless development system in which toner detachment from a doner and the concomitant generation of a controlled powder cloud is obtained by AC electric fields supplied by self spaced electrodes positioned within the development nip.

Nakamura et al. describes a control apparatus for controlling the concentration of toner incorporated in developing material by means of controlling toner replenishment. Specifically, a toner concentration detecting sensor signal is analyzed to detect an abnormal sensor condition. When such a situation occurs, toner is dispensed at a constant volume. If the sensor is operating normally, an average signal level is used to determine the toner volume to be dispensed.

Lux et al. describes an apparatus for controlling the concentration of toner within a developer material of carrier and toner. The apparatus having a control means for generating a toner addition signal indicative of the amount of toner to be added to the developer material. The control means including the ability to measure the concentration of toner within the developer material during at least a first period and a second period subsequent to the first period. The control means also determining a first concentration error as a function of the deviation between the toner concentration measured during the first period and a reference toner concentration and a second concentration error as a function of the deviation between the toner concentration measured during the second period and the reference toner concentration. Subsequently, the control means generates the toner addition signal as a function of the first and second concentration error values. The apparatus also includes means, responsive to the toner addition signal, for regulating the addition of toner to said developer material.

U.S. application Ser. No. 08/529,796 discloses An apparatus for controlling the concentration of toner within a developer material of carrier and toner. The apparatus having a magnetic roll for transporting a combination of carrier material and toner particles, a donor roll for transporting toner particles from said magnetic roll to a photoreceptor transfer zone, the magnetic roll and the donor roll each having a voltage applied thereto. A sensor measures the dynamic current between the magnetic roll and the donor roll and generates a signal as a function thereof. The dynamic current between the magnetic roll and the donor roll is a function of the concentration of the toner particles and the carrier material. As a result of the sensor output signal toner particles are added to the developer sump to maintain proper triboelectric properties within the developer unit.

In accordance with one aspect of the present invention, there is provided an apparatus for developing a latent electrostatic image on a charge retentive surface with toner, said apparatus comprising a supply of toner, a donor structure spaced from said charge retentive surface for conveying toner from said supply of toner to an area adjacent said charge retentive surface and a device for creating an alternating electrostatic field between said donor structure and said charge retentive surface to produce a toner cloud adjacent said charge retentive surface for developing the latent electrostatic image thereon.

In accordance with another aspect of the invention, there is provided an electrophotographic printing machine having a developer system utilizing two component developer in which toner is then transferred to a donor structure for forming a toner powder cloud adjacent a charge retentive surface, comprising a supply of toner, a donor structure spaced from said charge retentive surface for conveying toner from said supply of toner to an area adjacent said charge retentive surface and a device for creating an alternating electrostatic field between said donor structure and said charge retentive surface to produce a toner cloud adjacent said charge retentive surface for developing the latent electrostatic image thereon.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
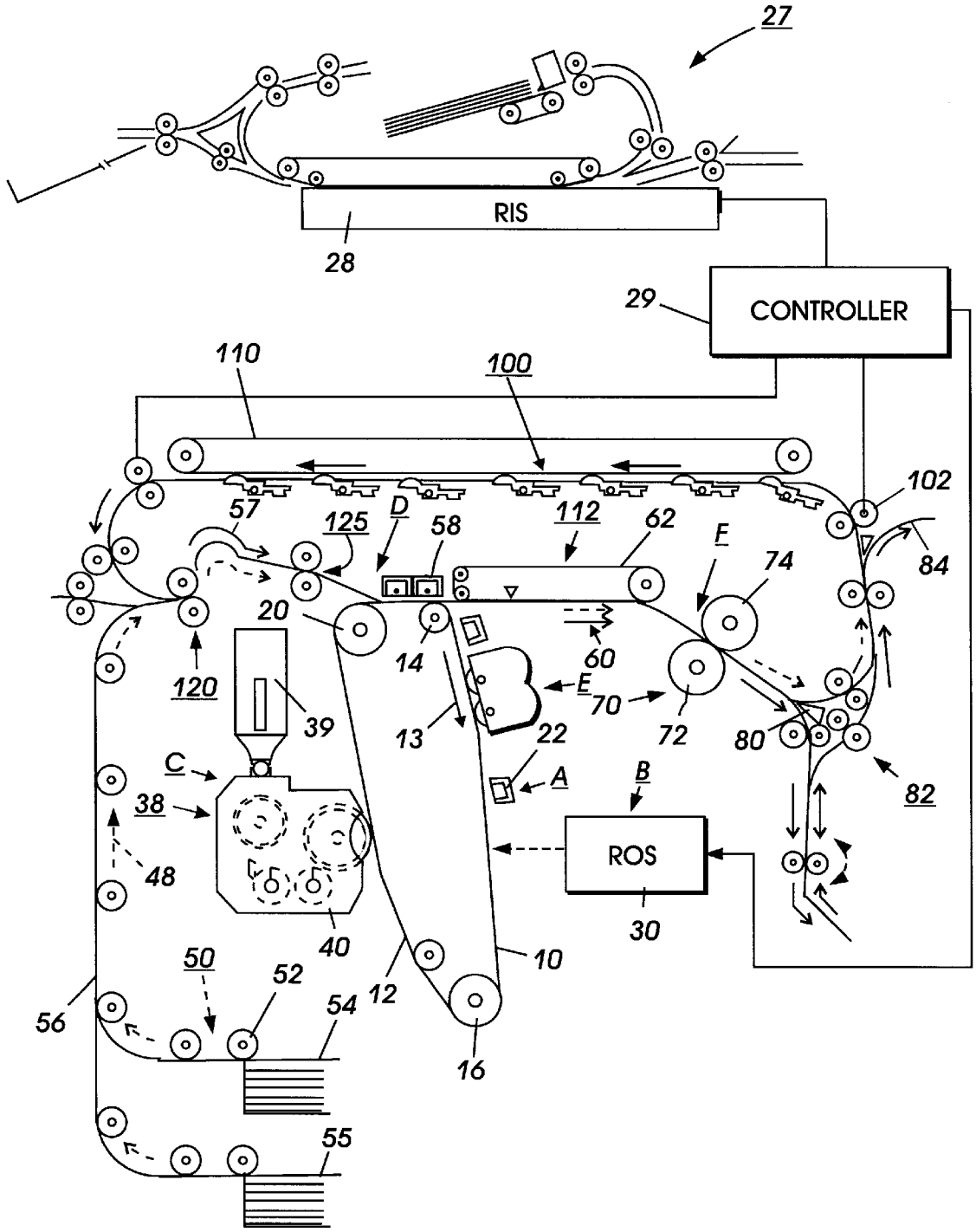
FIG. 1 is a schematic elevational view of a typical electrophotographic printing machine utilizing the toner maintenance system therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the development system of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using the device of the present invention as further described below. The latent image attracts toner particles from the carrier granules forming a toner powder image thereon. As successive electrostatic latent images are developed, toner particles are depleted from the developer material. A toner particle dispenser, indicated generally by the reference numeral 39, on signal from controller 29, dispenses toner particles into developer housing 40 of developer unit 38 based on signals from a toner maintenance sensor (not shown).

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into vertical transport 56. Vertical transport 56 directs the advancing sheet 48 of support material into registration transport 57 past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described including toner dispensing. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

It is believed that the foregoing description is sufficient for purposes of the present application to illustrate the general operation of an electrophotographic printing machine incorporating the features of the present invention therein.

Figure 2:
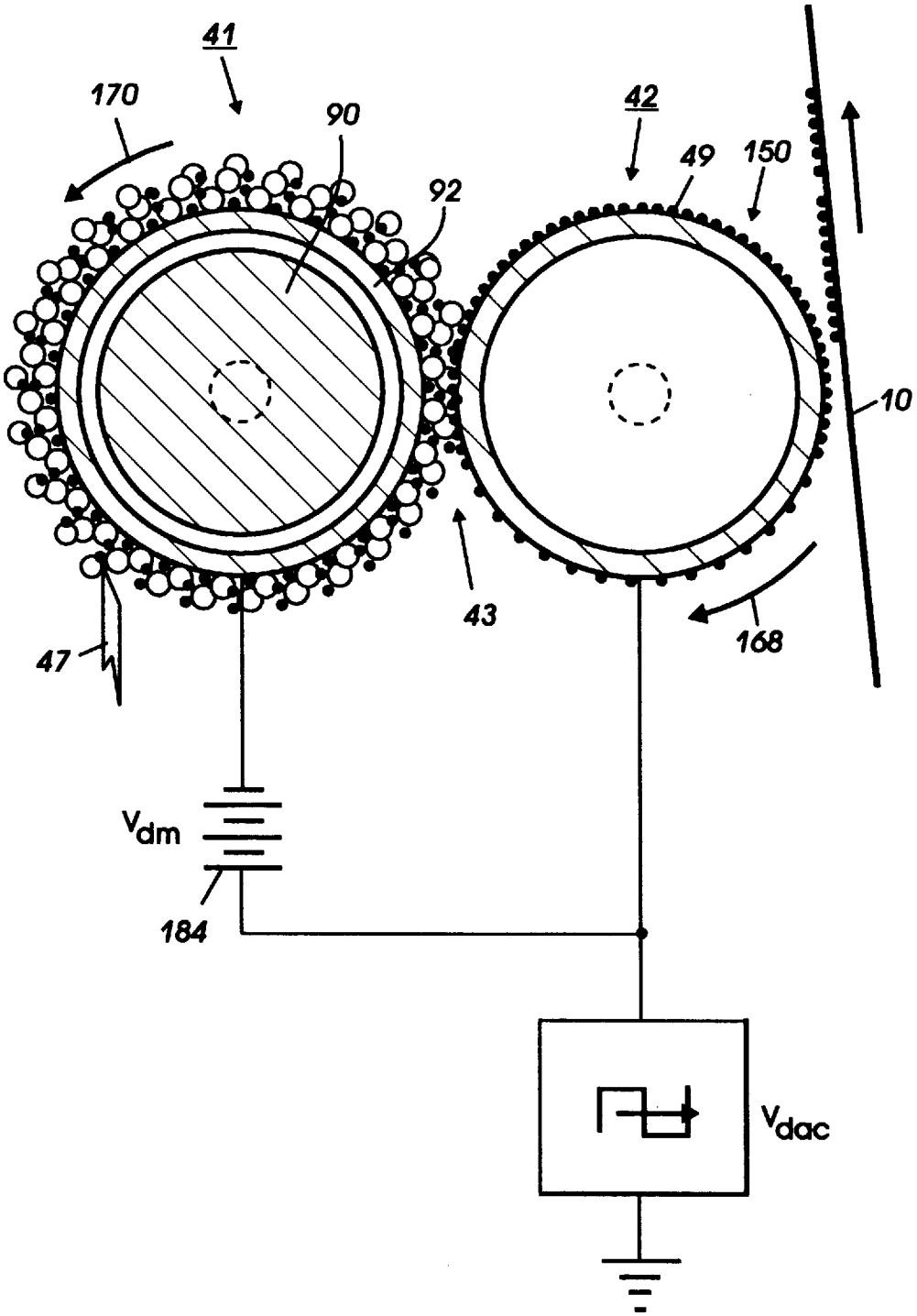
FIG. 2 is a schematic elevational view of the development system utilizing the invention herein.

Turning now to FIG. 2, there is shown development system 38 in greater detail. (More specifically a hybrid development system is shown where toner is loaded onto a donor roll from a second roll (e.g. a magnetic brush roll).) The toner is developed onto the photoreceptor from the donor roll using the hybrid jumping development system (HJD) described below. As shown thereat, development system 38 includes a housing 40 defining a chamber for storing a supply of developer material therein. Donor roller 42 and magnetic roller 41 are mounted in chamber of housing 40. The donor roller 42 can be rotated in either the 'with' or 'against' direction relative to the direction of motion of the photoreceptor 10.

In FIG. 2, donor roller 42 is shown rotating in the direction of arrow 168, i.e. the against direction. Similarly, the magnetic roller 41 can be rotated in either the 'with' or 'against' direction relative to the direction of motion of donor roller 42, In FIG. 2, magnetic roller 41 is shown rotating in the direction of arrow 170 i.e. the with direction. Donor roller 42 is preferably made from a conductive core which may be a metallic material with a semi-conductive coating such as a phenolic thereon.

Magnetic roller 41 meters a constant quantity of toner having a substantially constant charge onto donor roller 42. This ensures that the donor roller provides a constant amount of toner having a substantially constant charge as maintained by the present invention in the development gap. The preferred embodiment for the present invention is the combination of donor roller spacing, i.e. spacing between the donor roller and the magnetic roller, the compressed pile height of the developer material on the magnetic roller, and the magnetic properties of the magnetic roller in conjunction with the use of a conductive, magnetic developer material to achieve the deposition of a constant quantity of toner having a substantially constant charge on the donor roller. A DC bias supply 184 which applies approximately 100 volts to magnetic roller 41 establishes an electrostatic field between magnetic roller 41 and donor roller 42 so that an electrostatic field is established between the donor roller 42 and the magnetic roller 41 which causes toner particles to be attracted from the magnetic roller 41 to the donor roller 42. Metering blade 47 is positioned closely adjacent to magnetic roller 41 to maintain the compressed pile height of the developer material on magnetic roller 41 at the desired level. Magnetic roller 41 includes a non-magnetic tubular member 92 made preferably from aluminum and having the exterior circumferential surface thereof roughened. An elongated magnet 90 is positioned interiorly of and spaced from the tubular member. The magnet is mounted stationarily. The tubular member rotates in the direction of arrow 170 to advance the developer material adhering thereto into the nip 43 defined by donor roller 42 and magnetic roller 41. Toner particles are attracted from the carrier granules on the magnetic roller to the donor roller.

As described above, the potential "$V_{dm}$", about 100 volts, applied between the magnetic and donor rolls is used to set the amount of toner to be loaded on the donor roll. Single component jumping technology utilizing the device described below is used for the actual image development on the photoreceptor. The potential "$V_{dac}$", which is a 1.3 k volt zero to peak square wave at 3.25 k Hz, is used to generate the toner cloud by causing the toner particles in the image development nip formed by the donor roll and photoreceptor interface to move back and forth creating a toner particle cloud. In a known system, a potential "$V_{db}$" nominally set at 300 volts is used to control the developed image density (toner mass) on the photoreceptor. In general, the developed toner mass is approximately proportional to the dc development potential "$V_{db}$".

For a first order approximation, the maximum field for a 356 micron jumping gap and a 23 micron photoreceptor is:

$$E=(1300+300)/(356\times10^{-6}+23\times10^{-6}/3)=4.4\times10^{6}\ V/m$$

which is very close to the Paschen limit for air breakdown. This field may increase further if higher ac jumping or dc development potential is needed. Another concern for air breakdown is the reduction in the air gap every time the photoreceptor belt seam passes by the development nip. For a 3 mil thick seam, the field can increase to $5.6\times10^{6}$ V/m.

The development field latitude can be improved with the device described herein. While eliminating the dc development potential, $V_{db}$, the developed toner mass can be controlled by the duty cycle of the ac potential, "$V_{dac}$". The duty cycle is defined as the time ratio "R" of the negative going period with respect to the sum of the negative and positive going periods of the alternating potential.

The pulse width generated effective dc development potential can be approximated by the equation:

$$V_{eff}=(2R-1)*V_{dac}.$$

The following table gives the typical operating range of $V_{eff}$ as a function of R for $V_{dac}$=1300 volts.

| R | $V_{eff}$ |
|---|---|
| 0.45 | −130 V |
| 0.50 | 0 |
| 0.55 | 130 V |
| 0.60 | 260 V |
| 0.65 | 390 V |

Regardless of what the effective dc development potential is, the maximum field remains constant at:

$$E=1300/(356\times10^{-6}+23\times10^{-6}/3)=3.4\times10^{6}\ V/m.$$

This level of field has a lesser chance for air breakdown and provides the latitude for even higher ac jumping potentials if needed. In addition to the improved field latitude, the elimination of an adjustable dc power supply would also help to lower the total cost of the HJD system.

In recapitulation, there is provided a hybrid jumping development system utilizing two component developer and providing an improved method for controlling developed toner mass. Toner is metered onto a donor structure and a toner cloud is formed in a development nip between the donor structure and the charge retentive surface having a latent electrostatic image thereon. The toner cloud is formed by applying an alternating potential to the donor structure so as to cause the toner particles to jump off of the donor structure. The duty cycle of the AC potential is used to control the amount of toner developed on the charge retentive surface.

It is, therefore, apparent that there has been provided in accordance with the present invention, a hybrid jumping development system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims,

We claim:

1. An apparatus for developing a latent electrostatic image on a charge retentive surface with toner, said apparatus comprising:

a supply of toner;

a donor structure spaced from said charge retentive surface for conveying toner from said supply of toner to an area adjacent said charge retentive surface, wherein said donor structure has a continuous surface;

a device for applying an alternating current directly to said donor structure to create_an alternating electrostatic field between said donor structure and said charge retentive surface to produce a toner cloud adjacent said charge retentive surface for developing the latent electrostatic image thereon.

2. An apparatus according to claim 1, wherein said alternating electrostatic field has a pulse width regulated so as to control the developed toner mass on said charge retentive surface.

3. An apparatus according to claim 1 wherein said donor structure comprises a roll.

4. An apparatus according to claim 3, wherein said toner supply comprises:

a magnetic roll having a mixture of toner particles and developer particles thereon;

a device for creating a potential between said magnetic roll and said donor roll to regulate an amount of toner particles to be transferred from said magnetic roll to said donor roll.

5. An apparatus according to claim 1 wherein said alternating electrostatic field comprises a 1.3 kv to peak square wave at 3.25 khz.

6. An apparatus for developing a latent electrostatic image on a charge retentive surface with toner, said apparatus comprising:

a supply of toner;

a donor structure spaced from said charge retentive surface for conveying toner from said supply of toner to an area adjacent said charge retentive surface;

a device for creating an alternating electrostatic field between said donor structure and said charge retentive surface to produce a toner cloud adjacent said charge retentive surface for developing the latent electrostatic image thereon wherein said alternating electrostatic field has a pulse width regulated so as to control the developed toner mass on said charge retentive surface, wherein the pulse width is controlled in accordance with the following equation to generate an effective DC development potential wherein: $V_{effective}=(2R-1)*(V_{dac})$; wherein "R" comprises a time ratio of the negative going period with respect to the sum of the negative and positive going periods of the alternating potential.

7. An apparatus according to claim 6 wherein said donor structure comprises a roll.

8. An apparatus according to claim 7, wherein said toner supply comprises:

a magnetic roll having a mixture of toner particles and developer particles thereon;

a device for creating a potential between said magnetic roll and said donor roll to regulate an amount of toner particles to be transferred from said magnetic roll to said donor roll.

9. An apparatus according to claim 6 wherein said alternating electrostatic field comprises a 1.3 kv to peak square wave at 3.25 khz.

10. An electrophotographic printing machine having a developer system utilizing two component developer in which toner is then transferred to a donor structure for forming a toner powder cloud adjacent a charge retentive surface, comprising:

a supply of toner;

a donor structure spaced from said charge retentive surface for conveying toner from said supply of toner to an area adjacent said charge retentive surface, wherein said donor structure has a continuous surface;

a device for applying an alternating current directly to said donor structure to create_an alternating electrostatic field between said donor structure and said charge retentive surface to produce a toner cloud adjacent said charge retentive surface for developing the latent electrostatic image thereon.

11. A printing machine according to claim 10, wherein said alternating electrostatic field has a pulse width regulated so as to control the developed toner mass on said charge retentive surface.

12. A printing machine according to claim 10, wherein said donor structure comprises a roll.

13. A printing machine according to claim 12, wherein said toner supply comprises:

a magnetic roll having a mixture of toner particles and developer particles thereon;

a device for creating a potential between said magnetic roll and said donor roll to regulate an amount of toner particles to be transferred from said magnetic roll to said donor roll.

14. A printing machine according to claim 10, wherein said alternating electrostatic field comprises a 1.3 kv to peak square wave at 3.25 khz.

15. An electrophotographic printing machine having a developer system utilizing two component developer in which toner is then transferred to a donor structure for forming a toner powder cloud adjacent a charge retentive surface. comprising:

a supply of toner;

a donor structure spaced from said charge retentive surface for conveying toner from said supply of toner to an area adjacent said charge retentive surface;

a device for creating an alternating electrostatic field between said donor structure and said charge retentive surface to produce a toner cloud adjacent said charge retentive surface for developing the latent electrostatic image thereon wherein said alternating electrostatic field has a pulse width regulated so as to control the developed toner mass on said charge retentive surface, wherein said pulse width is controlled in accordance with the following equation to generate an effective DC development potential wherein: $V_{effective}=(2R-1)*(V_{dac})$; wherein "R" comprises a time ratio of the negative going period with respect to the sum of the negative and positive going periods of the alternating potential.

16. A printing machine according to claim 15, wherein said donor structure comprises a roll.

17. A printing machine according to claim 16, wherein said toner supply comprises:

a magnetic roll having a mixture of toner particles and developer particles thereon;

a device for creating a potential between said magnetic roll and said donor roll to regulate an amount of toner particles to be transferred from said magnetic roll to said donor roll.

18. A printing machine according to claim 15, wherein said alternating electrostatic field comprises a 1.3 kv to peak square wave at 3.25 khz.

* * * * *